US005898120A

United States Patent [19]

Kira

[11] Patent Number: 5,898,120

[45] Date of Patent: Apr. 27, 1999

[54] AUTO-PLAY APPARATUS FOR ARPEGGIO TONES

[75] Inventor: Yoshifumi Kira, Hamamatsu, Japan

[73] Assignee: Kabushiki Kaisha Kawai Gakki Seisakusho, Shizuoka-ken, Japan

[21] Appl. No.: 08/968,371

[22] Filed: Nov. 12, 1997

[30] Foreign Application Priority Data

Nov. 15, 1996 [JP] Japan ..... 8-321113

[51] Int. Cl.[6] ..... G10H 1/28

[52] U.S. Cl. ..... 84/638; 84/716

[58] Field of Search ..... 84/638, 716, 609–614, 84/DIG. 12, DIG. 22

[56] References Cited

U.S. PATENT DOCUMENTS 4,275,634 6/1981 Imamura et al. ..... 84/638

*Primary Examiner*—Stanley J. Witkowski

*Attorney, Agent, or Firm*—Hill & Simpson

[57] ABSTRACT

An auto-play apparatus has a ROM which pre-stores arpeggio pattern data including a sequence pattern, a trigger pattern, and a gater pattern, and a tone signal generation circuit for generating tones on the basis of these arpeggio pattern data. The apparatus can execute, in addition to a basic, monophonic arpeggio play according to depression of a keyboard unit, arpeggio plays in various play modes such as a polyphonic arpeggio play allowing to simultaneously produce two or more tones of those that form a chord, an arpeggio play allowing to simultaneously produce all the tones corresponding to ON keys, an arpeggio play allowing to gradually change the volume in a single pitch, and the like, thus broadening expression amplitude of performance.

7 Claims, 4 Drawing Sheets

FIG. 4A DATA STRUCTURE OF ARPEGGIO PATTERN
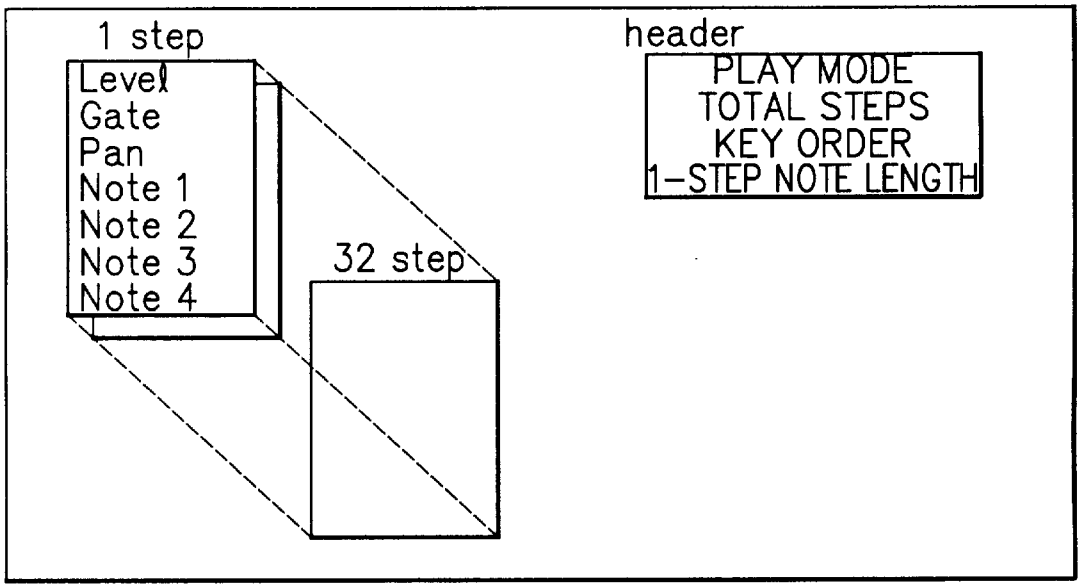
FIG. 4B PARAMETER USED IN PLAY MODES
| | Value | Gater | Trigger | Seq&Bsc |
|---|---|---|---|---|
| Level | emp/rep,1-27 | O | O | O |
| Gate | 1-250% | O | O | O |
| Pan | nc,63L-63R | X | O | O |
| Note 1 | Note No.1-12 | X | X | O |
| Note 2~4 | nc,Note No.1-12 | X | X | O |

AUTO-PLAY APPARATUS FOR ARPEGGIO TONES

BACKGROUND OF THE INVENTION

1. Field of the Invention

The present invention relates to an auto-play apparatus for automatically playing an arpeggio in response to key operation.

2. Description of the Related Art

Conventional electronic musical instruments such as an electronic piano, electronic keyboard, synthesizer, and the like can be played by operating keys on a keyboard unit. During the play, the tone colors, volumes, effects, and the like of tones produced by the electronic musical instrument are controlled in accordance with preset tone parameter data.

That is, when a player operates keys on the keyboard unit, corresponding tone waveform data are read out from a waveform data memory on the basis of key data representing the key operation states, and tone parameter data including the tone colors, volumes, effects, and the like set by operation members on a control panel unit. The readout tone waveform data are modified to produce desired tones.

Some of such electronic musical instruments comprise an automatic arpeggio play apparatus (arpeggiator). An arpeggio is a broken chord, notes of which are arranged in a broken pattern, and also means technique of such performance. For example, when C, E, and G keys are simultaneously pressed on the keyboard, the arpeggiator controls the play to produce the corresponding tones in turn one by one like C, E, G, C, E, G, . . . while the keys are kept pressed.

Normally, the arpeggiator has some play patterns such as an up pattern (C, E,G, C, E, G, . . . ), a down pattern (G, E, C, G, E, C, . . . ), a random pattern, and the like, and can also control the range, speed, and the like. The arpeggio pattern data are programmed as preset data, and the arpeggio play is controlled by reading out the preset data in correspondence with ON key events and supplying the readout data to a tone generation circuit.

However, the conventional arpeggiator can only play a basic, monophonic arpeggio that produces only one tone at one time. For this reason, although two tones composing a chord are often produced simultaneously in actual arpeggio performance, the conventional arpeggiator cannot play such arpeggio. Furthermore, the conventional arpeggiator cannot simultaneously produce tones corresponding to ON keys.

Moreover, since tones are switched by turning on/off notes, if a tone whose tone color changes in a single pitch is to be obtained, the generated tones sound discontinuous due to the note ON/OFF sequence.

The conventional arpeggiator does not allow the user to edit the pattern data prepared as preset data, and does not allow the user to create his or her desired arpeggio patterns.

SUMMARY OF THE INVENTION

The present invention has been made in consideration of the above situation, and has as its object to broaden the expression amplitude of performance by allowing arpeggio plays in various play modes such as a polyphonic arpeggio play allowing simultaneously producing two or more tones composing a chord, an arpeggio play allowing simultaneously producing all the tones corresponding to ON keys, an arpeggio play allowing gradually changing the volume in a single pitch, and the like, in addition to a basic, monophonic arpeggio play.

It is another object of the present invention to allow the user to arbitrarily create his or her desired arpeggio patterns to further broaden the expression amplitude of performance. In addition, it is further object of the present invention to allow the user to easily edit arpeggio patterns of the various play modes.

According to the present invention, an auto-play apparatus for automatically playing an arpeggio in accordance with keys depressed on a keyboard, comprises first storage means for pre-storing first arpeggio pattern data having a sequence that simultaneously produces two or more tones corresponding to keys depressed on the keyboard, second storage means for pre-storing second arpeggio pattern data that simultaneously produces all the tones corresponding to keys which are being depressed on the keyboard, third storage means for pre-storing third arpeggio pattern data that produces a tone while changing with time a volume of the tone corresponding to a key depressed on the keyboard, first buffer means for temporarily storing pattern data selected from the first to third arpeggio pattern data, and tone generation means for generating tones on the basis of the arpeggio pattern data stored in the first buffer means.

According to another aspect of the present invention, the apparatus further comprises edit means for storing the first to third arpeggio pattern data in second buffer means for editing, and editing the stored pattern data.

According to still another aspect of the present invention, the first to third arpeggio pattern data have an identical structure of data that form a pattern.

According to still another aspect of the present invention, the tone generation means generates a tone in accordance with the arpeggio pattern data in the second buffer means upon editing the pattern data.

According to still another aspect of the present invention, each of the first to third arpeggio pattern data is made up of a repetition pattern of a plurality of steps, each of which has at least a plurality of key data storage areas, and the edit means comprises means for writing repeat data for forcibly returning a step to be executed to the first step during execution of the steps.

According to still another aspect of the present invention, at least one of the plurality of key data storage areas included in each step of the first to third arpeggio pattern data always stores key data.

According to still another aspect of the present invention, each of the first to third arpeggio pattern data is made up of a repetition pattern of a plurality of steps, each of which has at least a gate time storage area, and gate time data to be stored in the gate time storage area is expressed by a ratio with respect to a reference time duration.

According to the present invention with the above-mentioned arrangement, arpeggio plays in various play modes such as a polyphonic arpeggio play allowing to simultaneously produce two or more tones composing a chord, an arpeggio play allowing to simultaneously produce all the tones corresponding to ON keys, an arpeggio play allowing to gradually change the volume in a single pitch, and the like can be executed in addition to a basic, monophonic arpeggio play.

According to another characteristic feature of the present invention, the first to third arpeggio pattern data pre-stored in the first to third storage means can be arbitrarily edited using the second buffer means for editing. In this case, when the first to third arpeggio pattern data have an identical structure, the data can be easily edited using the first to third arpeggio pattern data. Furthermore, when an arpeggio is played in accordance with the contents written in the second buffer means for editing upon editing the pattern data, an arpeggio play can be executed in real time while the arpeggio pattern data is being edited.

Additional features and advantages of the present invention are described in, and will be apparent from, the detailed description of the presently preferred embodiments and from the drawings.

BRIEF DESCRIPTION OF THE DRAWINGS

FIG. 4A is a view showing the structure of arpeggio pattern data stored in a play buffer (or edit buffer) in a RAM, and FIG. 4B is a view showing play modes and parameters used in the play modes.

DETAILED DESCRIPTION OF THE PREFERRED EMBODIMENTS

Figure 1:
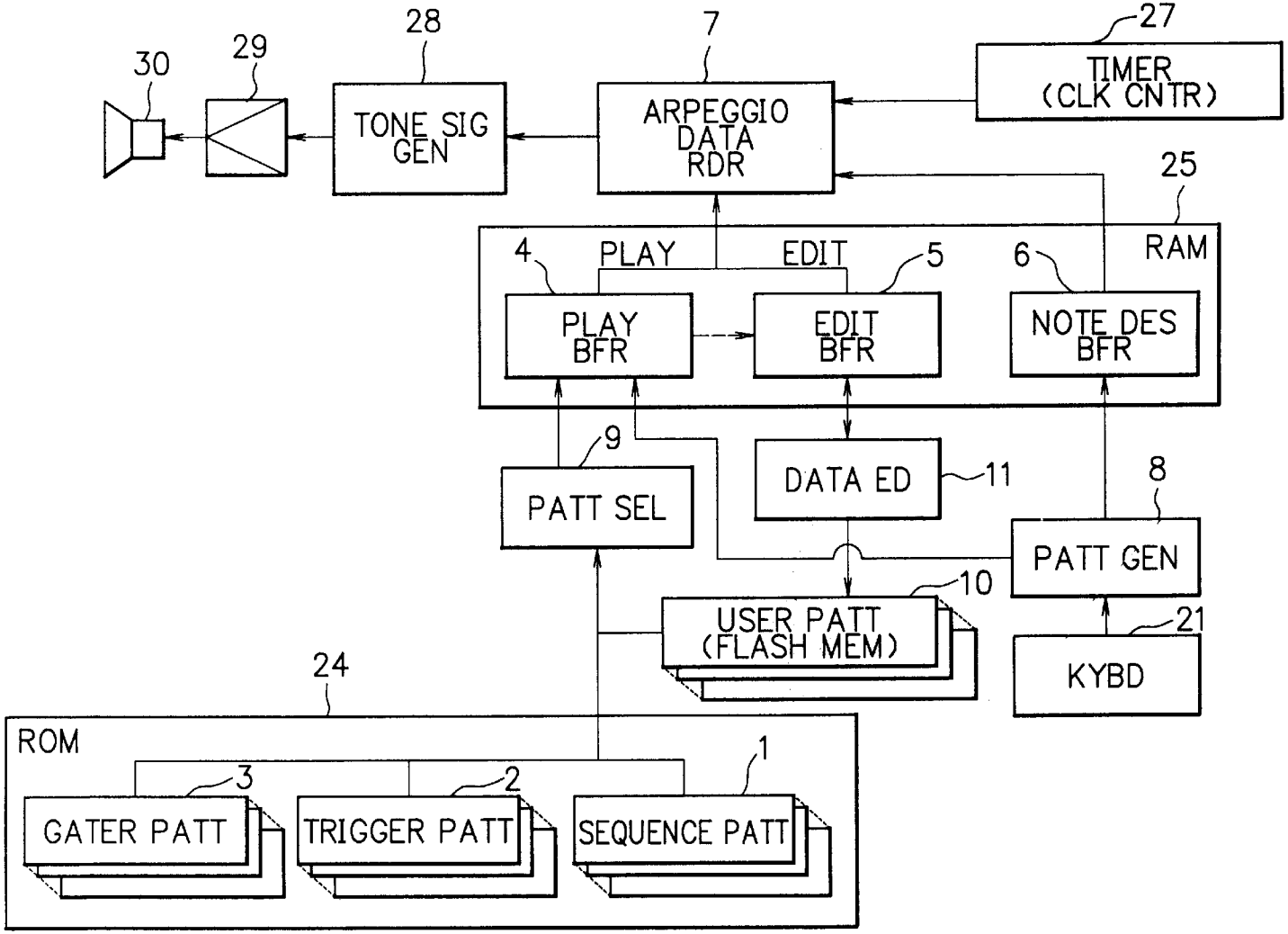
FIG. 1 is a block diagram showing the arrangement of principal part of an automatic arpeggio play apparatus according to an embodiment of the present invention.
Figure 2:
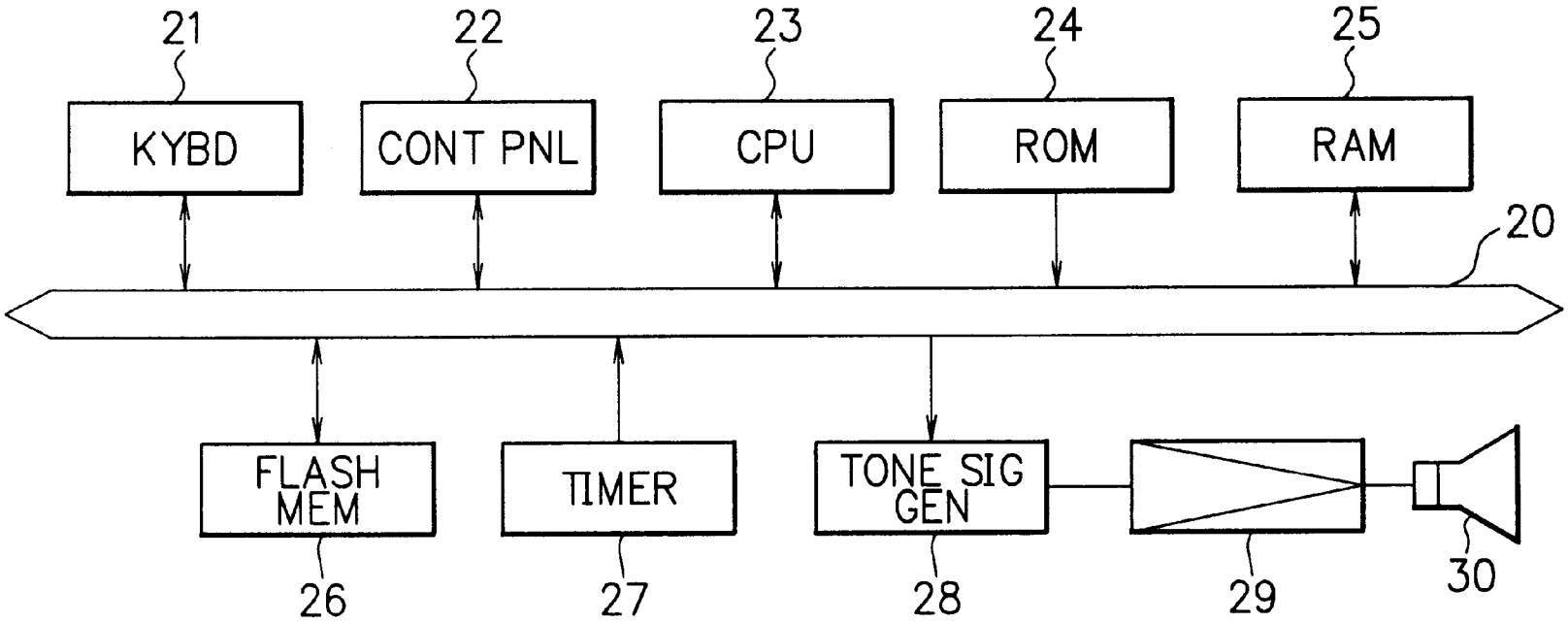
FIG. 2 is a schematic block diagram showing the arrangement of the overall electronic musical instrument which comprises the automatic arpeggio play apparatus of the embodiment shown in FIG. 1.

FIG. 1 is a block diagram showing the arrangement of principal part of an automatic arpeggio play apparatus (arpeggiator) according to an embodiment of the present invention, and FIG. 2 is a schematic block diagram showing the arrangement of the overall electronic musical instrument which comprises the arpeggiator. In the arpeggiator of this embodiment, an arpeggio play is attained by a microcomputer. Note that the same reference numerals denote common blocks in FIGS. 1 and 2.

Referring to FIG. 2, a keyboard unit 21, a control panel unit 22, a CPU 23, a ROM 24, a RAM 25, a nonvolatile flash memory 26, a timer 27, and a tone signal generation circuit 28 are connected to a bus line 20 including a data bus, address bus, and the like to exchange data with one another.

The keyboard unit 21 comprises one or a plurality of keyboards including a plurality of keys and key switches arranged in correspondence with the keys. The key switches detect ON/OFF key events and can also detect the key operation speeds.

The control panel unit 22 has operation members used for executing an automatic arpeggio play on the basis of arpeggio pattern data (for example, operation members for selecting various play modes, operation members for selecting arpeggio patterns, operation members for setting tempos, and the like, operation members used for editing arpeggio pattern data, indicators for indicating the states set by various operation members, and the like, in addition to various operation members for setting the tone colors, rhythms, volumes, effects, and the like.

The CPU 23 controls the overall electronic musical instrument using the RAM 25 as a work memory in accordance with a control program stored in the ROM 24. For example, the CPU 23 scans the key switches of the keyboard unit 21 and the operation members of the control panel unit 22 to detect the operation states (key ON/OFF events, key switch numbers of operated keys, velocities associated with key operation speeds, and the like) of the individual keys on the keyboard unit 21, and the operation states of the operation members on the control panel unit 22, thus executing various kinds of processing (to be described later) in accordance with these operation states of the keys and operation members.

The ROM 24 stores a work program of the CPU 23 and PCM tone waveform data used upon forming tone signals by the tone signal generation circuit 28, and also stores, as preset data, a plurality of different arpeggio pattern data used in an automatic arpeggio play.

In this embodiment, as shown in FIG. 1, the ROM 24 stores a plurality of different arpeggio pattern data corresponding to various play modes so as to execute arpeggio plays in various play modes such as a polyphonic arpeggio play (sequence pattern 1) allowing simultaneously to produce two or more tones composing a chord, a trigger play (trigger pattern 2) allowing simultaneously to produce all the tones corresponding to ON keys, a gater play (gater pattern 3) allowing to produce a tone corresponding to an ON key while changing its volume with time, and the like in addition to a basic, monophonic arpeggio play in response to the keyboard operation.

The RAM 25 has storage areas for temporarily storing various data required in a program execution process of the CPU 23, and storing data obtained as a result of various kinds of processing. Especially, in this embodiment, as shown in FIG. 1, the RAM 25 has a play buffer 4, edit buffer 5, and note designation buffer 6 as storage areas for storing arpeggio data to be supplied to the tone signal generation circuit 28.

The play buffer 4 stores data of an arpeggio pattern corresponding to the currently selected play mode. In a normal play mode, the tone signal generation circuit 28 plays an arpeggio in accordance with the contents of this play buffer 4. In a basic mode that executes a basic, monophonic arpeggio play, the play buffer 4 stores arpeggio pattern data generated by a pattern generator 8 in accordance with key operation on the keyboard unit 21.

Also, in a sequence mode for making a polyphonic arpeggio play, a trigger mode for simultaneously producing tones corresponding to ON keys, or a gater mode for producing a tone corresponding to an ON key while changing its volume with the time, the play buffer 4 stores arpeggio pattern data selected from the sequence pattern 1, trigger pattern 2, gater pattern 3, and user pattern 10 by a pattern selector 9 comprising mode selection operation members and pattern selection operation members on the control panel unit 22, the CPU 23, and the like.

The edit buffer 5 is used for editing arpeggio pattern data at a data editor 11 comprising various editing operation members on the control panel unit 22, the CPU 23, and the like. When the user instructs data editing, arpeggio pattern data stored in the play buffer 4 at that time is copied to the edit buffer 5. The user can edit the arpeggio pattern data on the edit buffer 5.

Upon editing the pattern data, the tone signal generation circuit 28 executes an arpeggio play in accordance with the contents of the edit buffer 5. With this arrangement, an arpeggio play corresponding to arpeggio pattern data which is being edited can be executed in real time. Hence, the user can efficiently edit data while audibly confirming the edited contents. The arpeggio pattern data edited by the data editor 11 is saved in the flash memory 26 as the user pattern 10, and can be used anytime the user wants.

Figure 3:
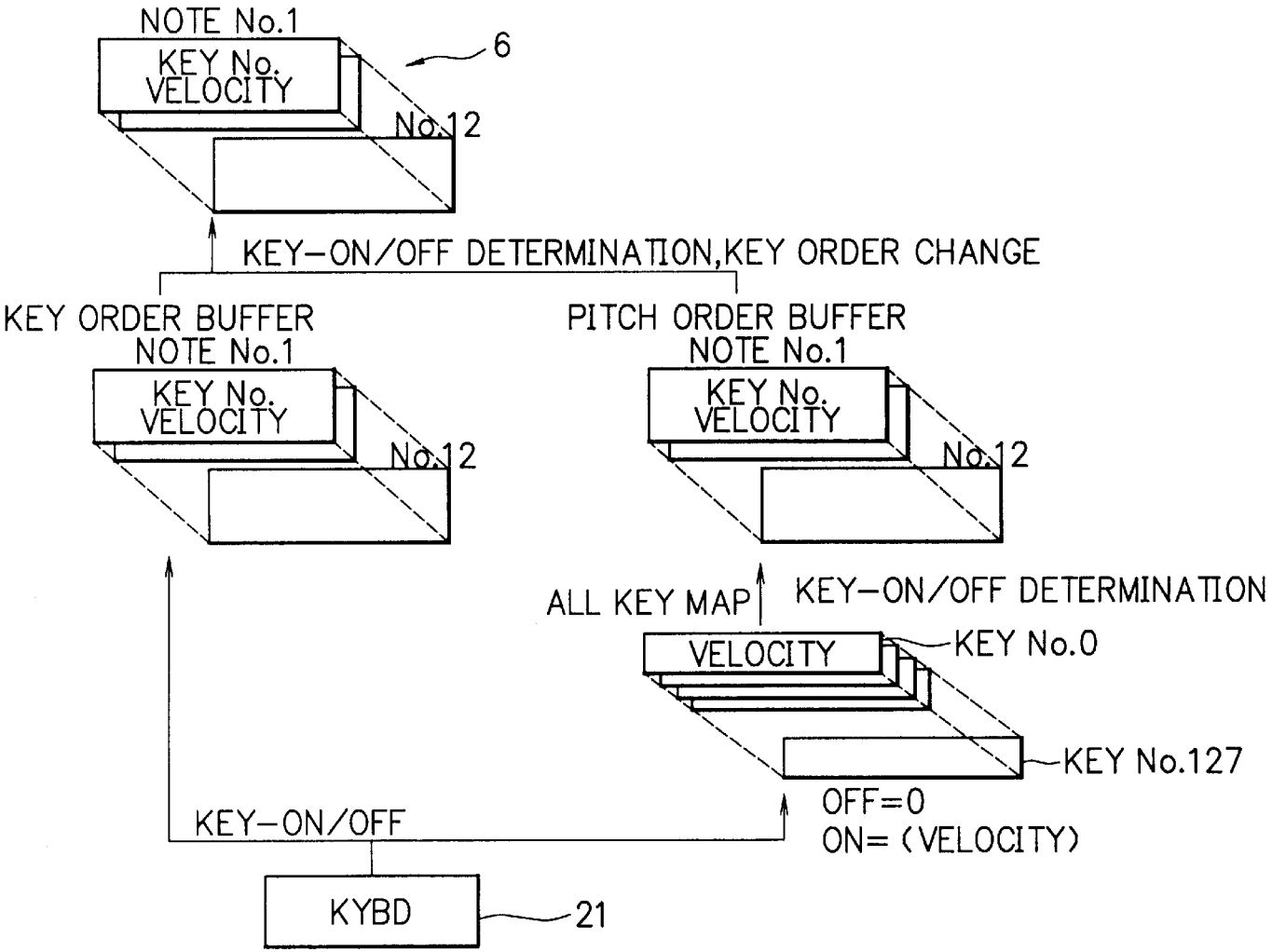
FIG. 3 is a chart showing the data flow when note data of a note designated by a keyboard operation is stored in a note designation buffer.

The note designation buffer 6 stores the note name of a tone to be actually produced as designated by the keyboard operation, and FIG. 3 shows the data flow when note name data is written in the note designation buffer 6.

As shown in FIG. 3, in this embodiment, when note name data designated by a key ON/OFF event on the keyboard unit 21 is written in the note designation buffer 6, the contents of two buffers, i.e., a key order buffer and pitch order buffer, are always rewritten, and the contents of one of these buffers are written in the note designation buffer 6.

The key order buffer stores the key numbers (Nos.) and velocities of keys in the depression order of these keys on the keyboard unit 21, and includes 12 buffers from note Nos. 1 to 12 in this embodiment. The pitch order buffer stores key Nos. and velocities corresponding to the ON keys on the keyboard unit 21 in the order from lower pitches, and includes 12 buffers from note Nos. 1 to 12. Numerals of note Nos. 1 to 12 indicate the priority order.

When the contents of the pitch order buffers are rewritten, the scan results of all the keys (128 keys with key Nos. 0 to 127 in this embodiment) on the keyboard unit 21 are mapped. Thereafter, when key ON/OFF events are determined, key Nos. and velocities are stored in the order from lower pitches. The reason why key ON/OFF events are determined after a given delay time is to cope with a hold mode that keeps the play after an ON key is released.

The arpeggiator of this embodiment has a key order mode for executing an arpeggio play in the key ON order for notes. When this mode is designated, the contents of the key order buffer are written in the note designation buffer 6. When the key order mode is not designated, the contents of the pitch order buffer are written in the note designation buffer 6. In the trigger mode, since all the tones corresponding to ON keys are produced, the contents of either the key order buffer or pitch order buffer may be used. For example, in this embodiment, the contents of the pitch order buffer are used in this mode.

Referring back to FIGS. 1 and 2, a timer 27 generates timing clocks for controlling the tempo of an automatic arpeggio play. When a desired arpeggio pattern is selected by operating a pattern selection operation member (not shown) on the control panel unit 22 and a tempo corresponding to the selected pattern is set by operating a tempo operation member (not shown), an arpeggio data reader 7 (made up of the CPU 23, and the like) repetitively reads out the selected arpeggio pattern data from the RAM 25 at the set tempo.

The tone signal generation circuit 28 comprises a plurality of tone generation channels, and can simultaneously generate a plurality of tones. The tone signal generation circuit 28 reads out PCM tone waveform data from the ROM 24 on the basis of key No. data representing each key sent from the CPU 23, tone parameter data set by operating operation members, and the like, then modifies its amplitude and envelope, and assigns the preset effects to the modified data to form digital tone data. The circuit 28 then D/A-converts the digital tone data to form an analog tone signal. The analog tone signal formed by the tone signal generation circuit 28 is amplified by an amplifier 29, and the amplified signal is supplied to a loudspeaker 30 to produce an actual tone.

FIG. 4A shows the structure of arpeggio pattern data stored in the play buffer 4 (or edit buffer 5). FIG. 4B shows play modes and parameters used in the play modes. The data structure shown in FIG. 4A is common to all the sequence pattern 1, trigger pattern 2, gater pattern 3, and user pattern 10 read out from the ROM 24 or the flash memory 26, and arpeggio patterns generated by the pattern generator 8 in correspondence with keyboard operation have the same data structure.

More specifically, in this embodiment, all the play modes, i.e., the basic mode, sequence mode, trigger mode, and gater mode have pattern data with the same structure. Although all the play modes have the same data structure, the individual modes use different data, as shown in FIG. 4B. FIGS. 4A and 4B will be described in detail below to explain this further.

As shown in FIG. 4A, arpeggio pattern data of this embodiment has patterns to be repetitively played back for 32 steps in accordance with clocks from the timer 27, and has Level, Gate, Pan, and Note1 to Note4 data in each of the first to 32nd steps. Also, the arpeggio pattern data has, as header data, a play mode, total steps, key order, and 1-step note length.

The play mode in the header information indicates one of the basic mode, sequence mode, trigger mode, and gater mode. Based on this play mode data, the data to be used is determined from those in each step (see FIG. 4B). The total steps is data indicating the total length (the total number of steps) of the arpeggio pattern, and assumes a value ranging from 1 to 32 in this embodiment. For example, if the total step is "16", the arpeggio data reader 7 reads out data from the first step to 16th step, and thereafter, returns to the first step.

The key order in the header data indicates whether or not the key order mode is designated (i.e., switching data indicating whether the contents of the key order buffer or pitch order buffer shown in FIG. 3 are to be used). The 1-step note length indicates the number of clocks per step, and for example, 96 clocks form one quarter note.

Of data in each step, the Level data indicates velocity data that represents the key ON speed (amplitude of tone generation) or volume data, and assumes a value ranging from 1 to 127. As shown in FIG. 4B, this Level data is used in all the play modes, and the value ranging from 1 to 127 indicates volume in the gater mode, and velocity in other modes.

Furthermore, in this embodiment, the Level data has emp/rep (empty/repeat)data in addition to the velocity or volume data. When repeat data is written in a given step, the control forcibly returns from that step to the first step. For example, when repeat data is written in Level data in the third step, even when the total step data is set to be four or more, data in the fourth step and subsequent steps are ignored, and the control returns to the first step. On the other hand, if empty data (no data is written in practice) is written, steps are repeated in accordance with the total step data as usual.

The empty/repeat data can be rewritten at need by the user using the data editor 11. Hence, an arpeggio pattern can be easily edited by writing repeat data at a desired step position without erasing each data present within the range of the total steps.

The Gate data indicates the gate time representing a tone duration, and assumes a value ranging from, e.g., 1 to 250%. Note that the gate time is stored not with an actual time value but with percentages based on a reference gate time (e.g., the duration of a quarter note; 100%).

As described above, the note length of one step is determined by the header data. For this reason, when the gate time is written as an actual time value, if a long gate time is set, the gate time becomes longer than the 1-step note length, and may overlap the tone in the next step. At this time, since the tone in the next step is preferentially produced in the overlapping portion, even when the long gate time is set, the tone in the overlapping portion with the next step is consequently not produced. In contrast to this, when the gate time is expressed by percentages, such problem can be solved.

The Pan data indicates the degree of panning of right and left tones when stereophonic tones are produced from, e.g., right and left loudspeakers. The Pan data assumes a value ranging from 1R to 63R for the right channel or a value ranging from 1L to 63L for the left channel. For example, when a value for the left channel is set in a given step, the tone signal generation circuit 28 controls to produce a tone from the left loudspeaker in that step. Note that nc is data indicating that data set in the previous step is reused as it is.

Each of the Note1 to Note4 data indicate one of note Nos. 1 to 12 shown in FIG. 3. Since the note designation buffer 6 indicated by one of note Nos. 1 to 12 stores a key No. and velocity for specifying the type of tone designated by keyboard operation, each of the Note1 to Note4 data represents the key No. and velocity corresponding to the stored note No.

In this case, the velocity data stored as the Level data and velocity data stored as the Note1 to Note 4 data overlap each other. Which velocity data is to be used is determined by the CPU 23 by checking as to whether or not the velocity mode (this mode indicates whether an arpeggio play is made based on the strength upon depression of the keyboard or the velocity data preset in the pattern, and can be set by the user) is set "ON" to indicate use of keyboard.

As shown in FIG. 4B, the Note2 to Note4 data may store nc data indicating that none of note Nos. 1 to 12 are stored, but the Note1 data always stores one of note Nos. 1 to 12.

As shown in FIG. 4B, the sequence mode and basic mode (up, down, random, and the like) use all the Level, Gate, Pan, and Note1 to Note4 data. On the other hand, the trigger mode does not use any Note1 to Note4 data since all the tones corresponding to ON keys (data stored in note Nos. 1 to 12 shown in FIG. 3) are produced.

The gater mode uses only the Level and Gate data since it allows a smooth change in tone color by gradually changing the volume in one pitch. That is, when the gater pattern 3 is read out to execute a play, it does not perform any note ON/OFF control. That is, the note ON/OFF control is done in accordance with keyboard operation on the keyboard unit 21, and the volume of the produced tone is controlled in accordance with the Level data.

As described above, in this embodiment, the individual play mode have the same data structure independently of data to be used, as shown in FIG. 4A. With this data structure, data can be easily edited by flexibly using the arpeggio pattern data among the respective play modes. For example, when the user likes only the rhythm of gater pattern data and wants to use that rhythm as a trigger pattern, he or she can realize such play by rewriting the play mode data in the header data.

As described above, the Note1 data never stores nc data and even the trigger pattern 2 and gater pattern 3 which do not use any Note1 to Note4 data formally have data for at least one note. Hence, by switching such pattern to the sequence pattern 1 that use all the Note1 to Note4 data by rewriting the header data in that pattern, tones corresponding to at least the Note1 data are always produced. In this manner, data can be edited by using arpeggio pattern data in the individual play modes while executing an arpeggio play in real time.

As has been described above with the aid of FIG. 3, in this embodiment, when keyboard operation at the keyboard unit 21 is detected, the contents of both key order buffer and pitch order buffer are rewritten. Hence, by rewriting the header data during editing arpeggio pattern data, designation of the key order mode can be switched in real time during the play.

The operations required for making arpeggio plays in the respective play modes will be described below with reference to FIG. 1 and FIGS. 4A and 4B.

The operation required for executing, e.g., an up-pattern arpeggio play in the basic mode will be explained below.

In this basic mode, a key No. and velocity of a tone corresponding to an ON key on the keyboard 21 are written in the note designation buffer 6. In this case, the pitch order buffer is used. For example, when C, E, and G keys are pressed, the key No. and velocity of "C" are written in note No. 1 in the note designation buffer 6; those of "E" in note No. 2; and those of "G" in note No. 3. Note that the same write operation to the note designation buffer 6 applies to other play modes to be described later.

The pattern generator 8 generates up-pattern arpeggio data in the play buffer 4 in the RAM 25. In this case, the Note1 area in the first step shown in FIG. 4A stores the number data of note No. 1, and Note2 to Note4 areas store nc data. In the second step, the Note1 area stores number data of note No. 2, and the Note2 to Note4 areas store nc data. Similarly, in the third step, the Note1 area stores number data of note No. 3, and the Note2 to Note4 areas store nc data. Note that the Level, Gate, and Pan areas in these steps store fixed values.

Subsequently, the arpeggio data reader 7 reads out the arpeggio pattern data loaded onto the play buffer 4 by the above-mentioned processing in accordance with the 1-step note length (the number of clocks per step) in the header data. Furthermore, the arpeggio data reader 7 reads out the key No. data and velocity data designated by note Nos. stored in the Note1 to Note4 area in the readout arpeggio pattern data from the note designation buffer 6, and supplies them to the tone signal generation circuit 28.

If the velocity mode is set "ON" to use keyboard, the tone signal generation circuit 28 uses the velocity data in the note designation buffer 6; otherwise, it uses the velocity stored as the Level data in the readout arpeggio pattern data to generate tones. In this case, the circuit 28 sets the number of clocks obtained by multiplying the 1-step note length stored as the arpeggio pattern data by the Gate data, and sets a note OFF state after it has counted up the set clocks. If the Pan data is available, the circuit 28 also sets this data at the same time. In this manner tones are repetitively produced in succession in a pattern defined by the first to third steps, and a monophonic arpeggio play is executed like C, E, G, C, E, G, . . . .

The operation required for executing an arpeggio play in the sequence mode will be described below.

In the sequence mode, arpeggio data in the sequence pattern 1 selected by the user is read out from the ROM 24, and is written in the play buffer 4 in the RAM 25.

The arpeggio data reader 7 reads out the arpeggio pattern data loaded on the play buffer 4 in this manner in accordance with the 1-step note length (the number of clocks per step) in the header data. Furthermore, the arpeggio data reader 7 reads out the key No. data and velocity data designated by note Nos. stored in the Note1 to Note4 area in the readout arpeggio pattern data from the note designation buffer 6, and supplies them to the tone signal generation circuit 28.

If the velocity mode is set "ON" to use keyboard, the tone signal generation circuit 28 uses the velocity data in the note designation buffer 6; otherwise ("OFF" not to use keyboard), it uses the velocity stored as the Level data in the readout arpeggio pattern data so as to generate tones. In this case, the circuit 28 sets the number of clocks obtained by multiplying the 1-step note length stored as the arpeggio pattern data by the Gate data, and sets a note OFF state after it has counted up the set clocks. If the Pan data is available, the circuit 28 also sets this data at the same time.

In this manner, if the sequence pattern data selected by the user includes a sequence for simultaneously producing two or more tones (two or more note Nos. are stored in the Note1 to Note4 areas in one step shown in FIG. 4A), a polyphonic arpeggio play that produces two or more tones at the same time is executed in that sequence portion; if only one note No. is stored in the Note1 to Note4 area in one step, a monophonic arpeggio play using a single tone is executed.

The operation required for executing an arpeggio play in the trigger mode will be explained below.

In the trigger mode, arpeggio data in the trigger pattern 2 selected by the user is read out from the ROM 24, and is written in the play buffer 4 in the RAM 25.

The arpeggio data reader 7 reads out the arpeggio pattern data loaded on the play buffer 4 in this manner in accordance with the 1-step note length (the number of clocks per step) in the header data. Also, the arpeggio data reader 7 reads out all the data (key No. and velocity data) in the note designation buffer 6, and supplies them to the tone signal generation circuit 28. In this trigger mode, data may be written in the note designation buffer 6 with using either data in the key order buffer or note name buffer.

If the velocity mode is set "ON" to use keyboard, the tone signal generation circuit 28 uses the velocity data in the note designation buffer 6; otherwise ("OFF" not to use keyboard), it uses the velocity stored as the Level data in the readout arpeggio pattern data so as to generate tones. In this case, the circuit 28 sets the number of clocks obtained by multiplying the 1-step note length stored as the arpeggio pattern data by the Gate data, and sets a note OFF state after it has counted up the set clocks. If the Pan data is available, the circuit 28 also sets this data at the same time.

In this manner, an arpeggio play that produces all the tones corresponding to ON keys in accordance with the selected trigger pattern is executed. Using this trigger mode, a play such as a chord cutting play of the guitar that cannot be done in the conventional apparatus can be realized.

The operation required for making an arpeggio play in the gater mode will be described below.

In the gater mode, arpeggio data in the gater pattern 3 selected by the user is read out from the ROM 24, and is written in the play buffer 4 in the RAM 25.

The arpeggio data reader 7 reads out the arpeggio pattern data loaded on the play buffer 4 in this manner in accordance with the 1-step note length (the number of clocks per step) in the header data. In this gater mode, note ON/OFF control is done in accordance with key ON/OFF events on the keyboard unit 21.

The tone signal generation circuit 28 uses the Level data read out from the play buffer 4 as volume data, and uses the detected value in association with a key ON event as velocity data, thus producing a tone. In this case, the circuit 28 sets the number of clocks obtained by multiplying the 1-step note length stored as the arpeggio pattern data by the Gate data, and sets the volume value at "0" after it has counted up the set clocks. In this manner, an arpeggio play that gradually changes the volume in one pitch is executed. By using the gater mode, the tone color can be smoothly changed without disturbing the continuity of tone generation.

As described above, since the automatic arpeggio play apparatus according to the present invention comprises first to third storage means which pre-store first arpeggio pattern data having a sequence for simultaneously producing two or more tones corresponding to ON keys, second arpeggio pattern data for simultaneously producing all the tones corresponding to ON keys, and third arpeggio pattern data for producing a tone while changing the volume of the tone corresponding to an ON key with time, and tone generation means for generating a tone on the basis of the stored arpeggio pattern data. Arpeggio plays in various play modes such as a polyphonic arpeggio play allowing to simultaneously produce two or more tones composing a chord, an arpeggio play allowing to simultaneously produce all the tones corresponding to ON keys, an arpeggio play allowing to gradually change the volume in a single pitch, and the like can be executed in addition to a basic, monophonic arpeggio play. This broadens the expression amplitude of performance as compared to the conventional apparatus that can only execute a monophonic arpeggio play. Also, a tone whose tone color can be smoothly changed in one pitch can be obtained.

According to another feature of the present invention, since the apparatus also has edit means for editing the first to third arpeggio pattern data, the first to third arpeggio pattern data pre-stored in the first to third storage means can be edited to freely generate user's desired pattern data.

According to still another feature of the present invention, since the first to third arpeggio pattern data have an identical structure, different pattern data can be generated reusing the contents of another pattern data at the same time editing the pattern data. The data can be edited with flexibility using the first to third arpeggio pattern data.

According to still another feature of the present invention, since an arpeggio play is executed in accordance with the contents written in second buffer means for editing upon editing pattern data, the arpeggio play can be executed in real time while editing the arpeggio pattern data. Hence, the user can efficiently edit pattern data while audibly confirming the edited contents.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An auto-play apparatus for automatically playing an arpeggio in accordance with keys depressed on a keyboard, comprising:

first storage means for pre-storing first arpeggio pattern data having a sequence that simultaneously produces at least two tones corresponding to keys depressed on the keyboard;

second storage means for pre-storing second arpeggio pattern data that simultaneously produces all the tones corresponding to keys which are being depressed on the keyboard;

third storage means for pre-storing third arpeggio pattern data that produces a tone while changing with time a volume of the tone corresponding to a key depressed on the keyboard;

first buffer means for temporarily storing pattern data selected from the first to third arpeggio pattern data; and tone generation means for generating tones on the basis of the arpeggio pattern data stored in said first buffer means.

2. The apparatus according to claim 1 further comprising:

edit means for storing the first to third arpeggio pattern data in a second buffer means for editing, and editing the stored pattern data.

3. The apparatus according to claim 1 wherein the first to third arpeggio pattern data have an identical structure of data that form a pattern.

4. The apparatus according to claim 2 wherein said tone generation means generates a tone in accordance with the arpeggio pattern data in said second buffer means upon editing the pattern data.

5. The apparatus according to claim 2 wherein each of the first to third arpeggio pattern data is made up of a repetition pattern of a plurality of steps, each of which has at least a plurality of key data storage areas; and said edit means comprises means for writing repeat data for forcibly returning a step to be executed to the first step during execution of the steps.

6. The apparatus according to claim 5 wherein at least one of the plurality of key data storage areas included in each step of the first to third arpeggio pattern data always stores key data.

7. The apparatus according to claim 1 wherein each of the first to third arpeggio pattern data is made up of a repetition pattern of a plurality of steps, each of which has at least a gate time storage area; and gate time data to be stored in the gate time storage area is expressed by a ratio with respect to a reference time duration.

* * * * *